US007563511B2

(12) United States Patent
Koo

(10) Patent No.: US 7,563,511 B2
(45) Date of Patent: Jul. 21, 2009

(54) EXTERNAL DECORATING MEMBER FOR REFRIGERATOR DOOR

(75) Inventor: Ja Hun Koo, Changwon (KR)

(73) Assignee: LG Electronics Inc., Seoul (KR)

( * ) Notice: Subject to any disclaimer, the term of this patent is extended or adjusted under 35 U.S.C. 154(b) by 244 days.

(21) Appl. No.: 10/488,891

(22) PCT Filed: Aug. 5, 2002

(86) PCT No.: PCT/KR02/01480

§ 371 (c)(1),
(2), (4) Date: Mar. 8, 2004

(87) PCT Pub. No.: WO03/023298

PCT Pub. Date: Mar. 20, 2003

(65) Prior Publication Data

US 2004/0183413 A1 Sep. 23, 2004

(30) Foreign Application Priority Data

Sep. 7, 2001 (KR) ..... 2001-0055219

(51) Int. Cl.
*B32B 15/00* (2006.01)
*A47F 3/04* (2006.01)

(52) U.S. Cl. ..... 428/428; 428/432; 62/246; 62/249

(58) Field of Classification Search ..... 428/428, 428/432, 697, 699, 13, 14, 29
See application file for complete search history.

(56) References Cited

U.S. PATENT DOCUMENTS

| | | | | |
|---|---|---|---|---|
| 5,520,453 | A * | 5/1996 | Aoki et al. | 312/406 |
| 6,481,353 | B1 * | 11/2002 | Geddes et al. | 101/491 |
| 6,790,525 | B2 * | 9/2004 | Takeuchi et al. | 428/339 |

FOREIGN PATENT DOCUMENTS

| | | | |
|---|---|---|---|
| CN | 1066835 | A | 12/1992 |
| JP | 02-236350 | | 9/1990 |
| JP | 05-126461 | | 5/1993 |
| JP | 05 133677 | A | 5/1993 |
| JP | 05-322436 | | 12/1993 |
| JP | 10 034811 | A | 2/1998 |
| JP | 2000 254998 | A | 9/2000 |

* cited by examiner

*Primary Examiner*—Timothy M Speer
(74) *Attorney, Agent, or Firm*—Ked & Associates LLP

(57) ABSTRACT

An external decorating member installed on the surface of a refrigerator is disclosed, in which the external decorating member 20 comprises a glass member 22, a first paint layer 24 formed on top of the glass member 22 and having reflecting materials for reflecting light which passed through the glass member, and a second paint layer 26 formed on top of the first paint layer 24 and having a certain color.

13 Claims, 5 Drawing Sheets

EXTERNAL DECORATING MEMBER FOR REFRIGERATOR DOOR

TECHNICAL FIELD

The present invention relates to a refrigerator, and more particularly, to an external decorating member for a refrigerator door.

PRIOR ART

Generally, a refrigerator generates the cool air using a refrigerating system mounted therein and supplies the cool air into a refrigerating chamber and a freezing chamber so as to freshly preserve the food stored in the refrigerating and freezing chambers for a long time. A general construction of a typical refrigerator will be described with reference to FIG. 1.

As shown in FIG. 1, the refrigerator includes a main body 1 provided with a refrigerating chamber 2 and a freezing chamber (not shown). The refrigerating chamber 2 having a plurality of shelves 3 for placing the food inside the chamber preserves the food at a low temperature by ventilating the cool air. The freezing chamber for preserving frozen food is separated from the refrigerating chamber 2 by a barrier (not shown). The freezing and refrigerating chambers may be positioned either up and down or side by side inside the main body 1.

The main body further includes doors 5 and 5' for opening and closing the refrigerating and freezing chambers. The doors 5 and 5' have an outer case 5*a* made of steel and an inner case 5*b* made of synthetic resin. The outer case 5*a* is formed to externally decorate the refrigerator and the inner case 5*b* is formed to make some space between the outer case 5*a* and itself. The surface of the outer case 5*a* is covered with paint so that it is not exposed. Also, the space between the outer and inner cases 5*a* and 5*b* is filled with an insulator (not shown) to insulate the refrigerator 2. Each outer case 5*a* is provided with a door handle 5*c* on its surface so that the doors 5 and 5' are easily opened or closed.

The refrigerator doors of the prior art, however, have following limitations. Because the doors 5 and 5' are formed on the front surfaces of the refrigerating chamber 2 and the freezing chamber respectively, the outer case 5*a* is directly exposed when the doors 5 and 5' are closed. That is, the paint coated on the surface of the outer case 5*a* is seen. However, because the doors 5 and 5' coated with the paint show only a simple color, the prior art refrigerator can not satisfy customers with their various tastes.

DISCLOSURE OF THE INVENTION

Accordingly, the present invention is directed to an external decorating member for a refrigerator door that substantially obviates one or more problems due to limitations and disadvantages of the prior art.

An object of the present invention is to provide a refrigerator with a more sophisticated and elegant external appearance.

To achieve this object and other advantages and in accordance with the purpose of the invention, the refrigerator of the present invention includes a glass member, a first paint layer formed on top of the glass member and having a reflecting material for reflecting the light which passed through the glass member, and a second paint layer formed on top of the first paint layer and having a certain color.

The glass member is a plate member attached to the front surface of a refrigerator door and has the same size as the front surface of the same. Preferably, the glass member is made of tempered glass having an improved stiffness by being hardened by heat.

It is preferred that the first paint layer has its thickness in the range of 5-20 mμ and, more accurately, in the range of 10-15 mμ. The reflecting material of the first paint layer is made of an inorganic pigment or metal particles. The first paint layer is spontaneously dried at the normal temperature before the second pigment is dried.

Also, it is preferred that the second paint layer has its thickness in the range of 5-35 mμ and, more accurately, in the range of 10-30 mμ. The second paint layer is artificially dried by heat.

It is better for both the first and second paint layers to be made of a heat-resisting ceramic pigment. The second paint layer of the external decorating member is respectively provided to the doors 5 and 5' so that it comes in contact with the front surface of its corresponding door.

As described above, the refrigerator of the present invention, on the surfaces of its doors 5 and 5', has the glass member coated with various colors and especially with a pigment having the reflecting material. Accordingly, the refrigerator of the present invention can satisfy consumers with their various tastes and thus the commercial value of the refrigerator also increases.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Reference will now be made in detail to the preferred embodiments of the present invention, examples of which are illustrated in the accompanying drawings.

Figure 1:
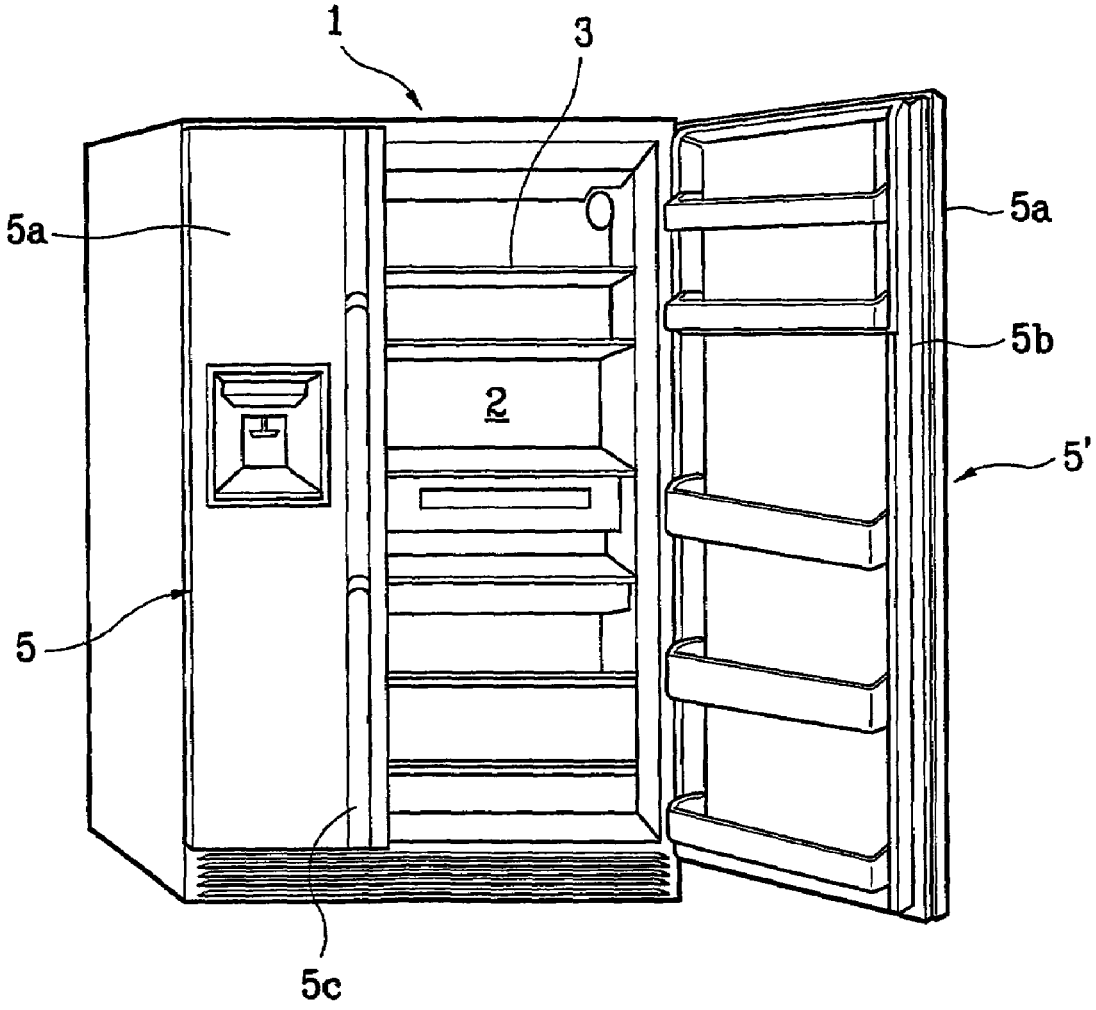
FIG.1 Prior Art
FIG. 1 is a perspective view illustrating the construction of a refrigerator of the prior art.
Figure 2:
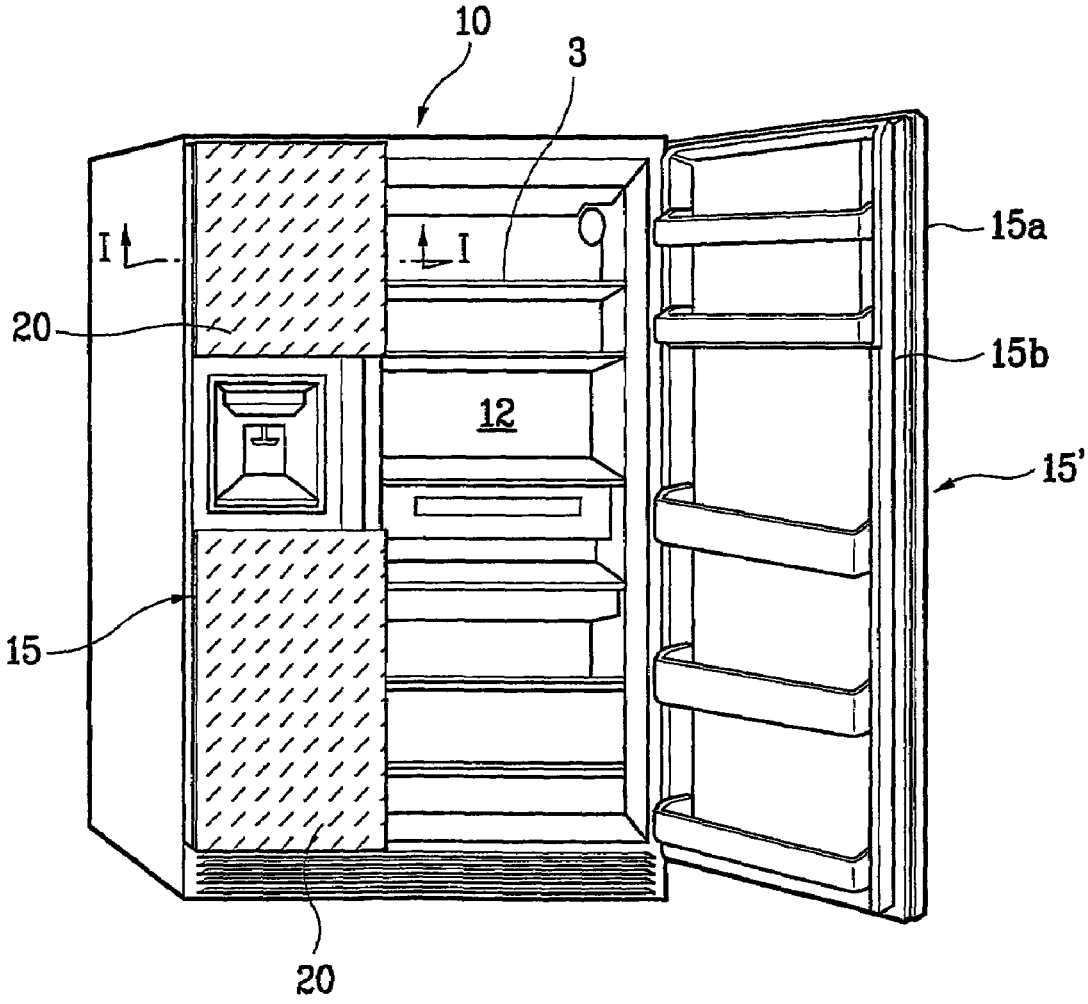
FIG. 2 is a perspective view illustrating a refrigerator provided with an external decorating member in accordance with the present invention.
Figure 3:
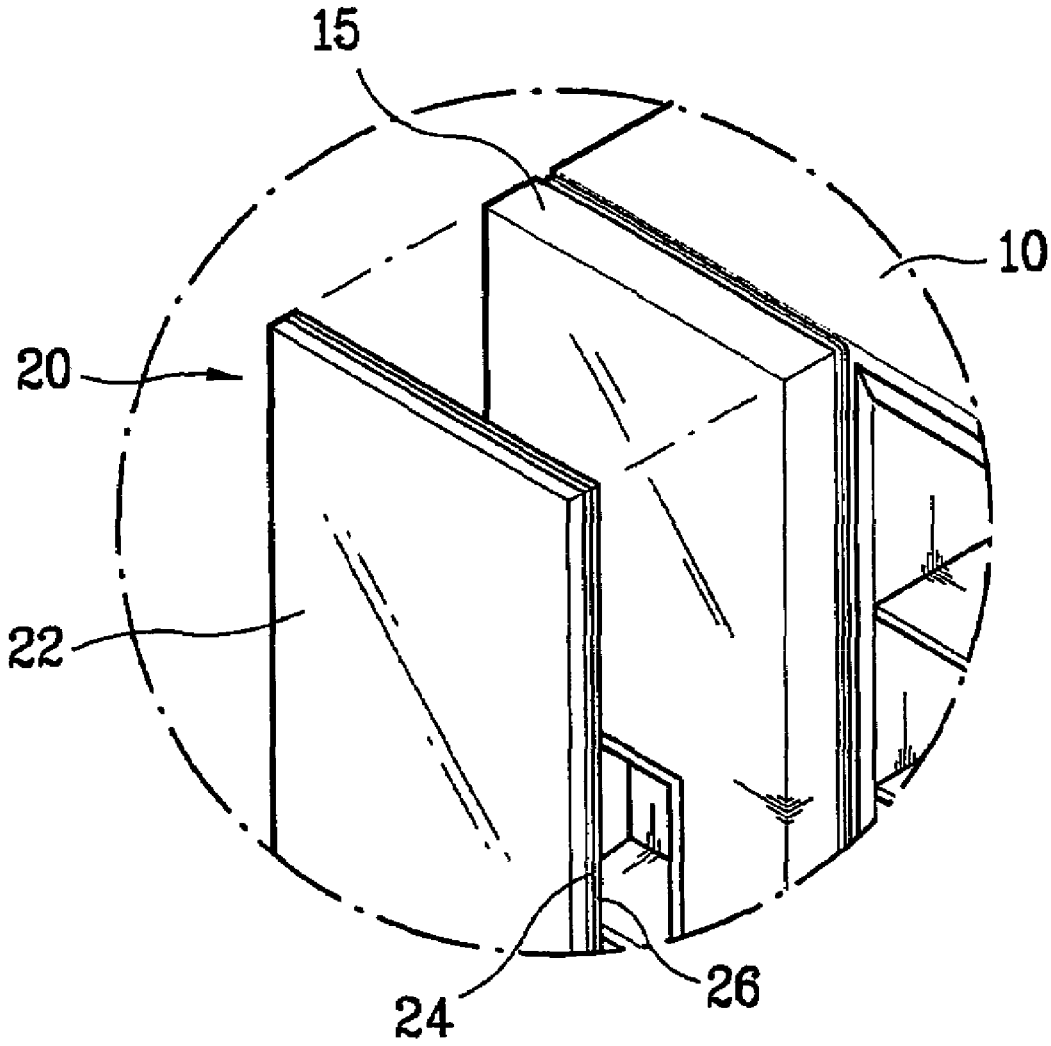
FIG. 3 is a fragmentary perspective view illustrating an external decorating member in accordance with the present invention.

FIG. 2 is a perspective view illustrating a refrigerator with an external decorating member in accordance with the present invention and FIG. 3 is a fragmentary perspective view illustrating the external decorating member in accordance with the present invention. In addition, FIG. 4 is a cross-sectional view taken along line I-I shown in FIG. 2 and illustrating a refrigerator door with the external decorating member in accordance with present invention.

As shown in FIG. 2, doors 15 and 15' are respectively provided to a refrigerating chamber 12 and a freezing chamber of a main body 10. Each of the doors 15 and 15' have outer and inner cases 15*a* and 15*b*. In the present invention, however, an external decorating member 20 is additionally provided on the front surfaces of the outer case of the doors, which are exposed to a user.

Figure 4:
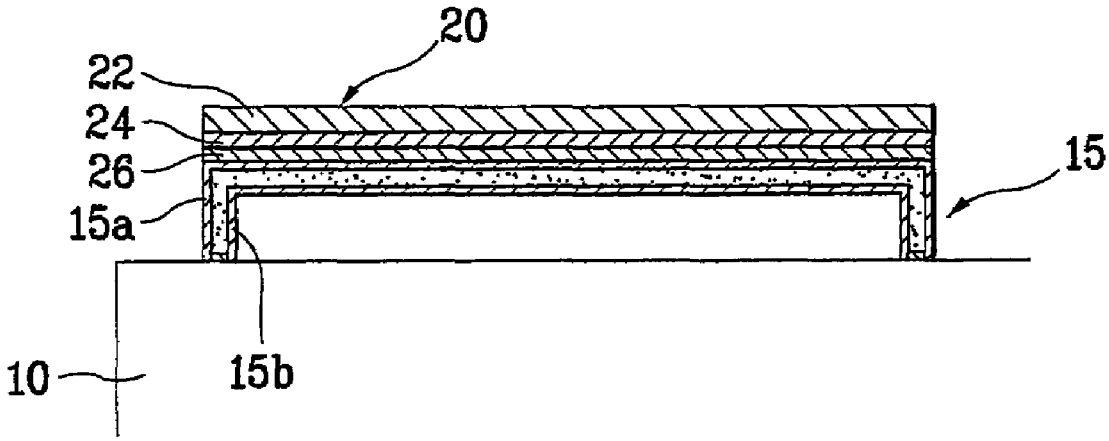
FIG. 4 is a cross-sectional view taken along line I-I shown in FIG. 2 and illustrating a door with an external decorating member in accordance with present invention.

Regarding to FIGS. 3 and 4, the external decorating member 20 includes a glass member 22 with a predetermined size, a first paint layer 24 formed on the surface of the glass member 22, and a second paint layer 26 formed on the first paint layer 24.

Figure 5:
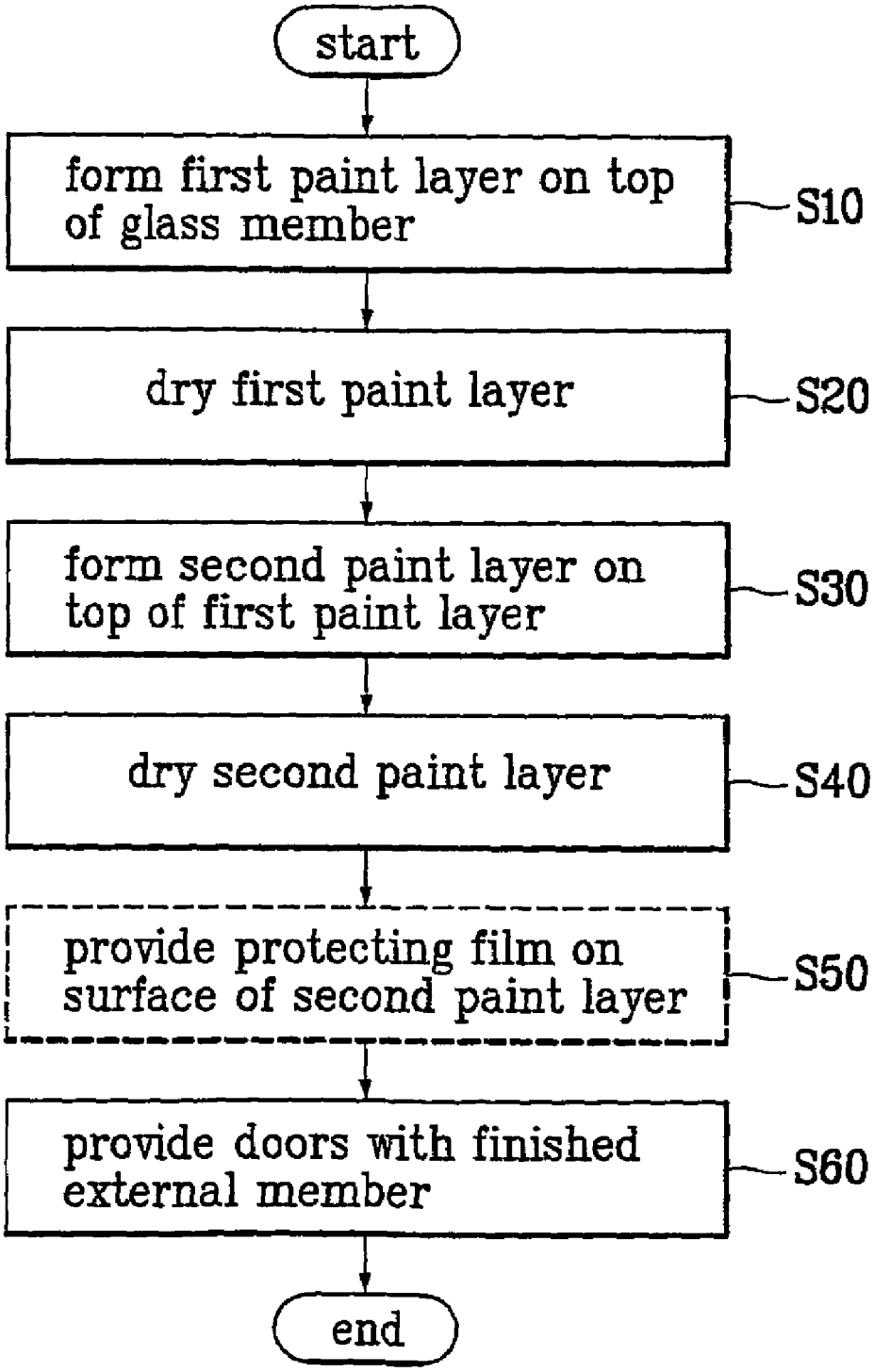
FIG. 5 is a flow chart illustrating a method of manufacturing an external decorating member in accordance with the present invention.

The external decorating member 20 will be described in more detail with reference to FIG. 5 illustrating a manufacturing process of the external decorating member 20.

The glass member 22, a plate member attached to the front surface of its corresponding door, makes the first and second paint layers 24 and 26 visible because of the transparent property of itself. Preferably, the glass member 22 has the same size as the front surface of its corresponding door, so as to fully decorate the front surfaces of the doors 15 and 15'. Also, it is preferred that the glass member 22 is made of tempered glass hardened by heat and thus having a high degree of solidity to resist against an external shock.

The first paint layer 24 is formed by coating the glass member 22 with the paint containing certain reflecting materials (S10). In this instance, a spray gun for spraying the paint containing the reflecting material on the glass member 22 is used to evenly form the first paint layer 22. The first paint layer 24 is sprayed relatively thinly, that is, in the thickness of 5-20 mμ (more preferably, in the thickness of 10-15 mμ), so that the second paint layer which is sprayed after the first paint layer can be shown through the first paint layer 24. The reflecting material of the first paint layer 24 may be made of an inorganic paint or metal particles and play a role to reflect light. When light enters the first paint layer 24 through the glass member 22, the reflecting material reflects the light.

The first paint layer 24 is spontaneously dried at the room temperature for a predetermined time after firstly being sprayed (S20).

Then, the paint having a certain color is secondly sprayed on the first paint layer 24 to form the second paint layer 26 (S30). In this instance, similar to a forming stage of the first paint layer 24, the spray gun is used to spray the pigment on the first paint layer 24. The second paint layer 26, the final paint layer, should be formed with relatively thick, in the range of 5-35 mμ (more preferably, in the range of 10-30 mμ), so that it is not peeled off easily. The second paint layer 26 may have any colors according to its design.

After the second paint layer 24 is completely formed, it is dried for a predetermined time (S40). Unlike the first paint layer 24, however, the second paint layer 26 is artificially dried by heat. This is because that the second paint layer 26 is not easily adhered to the first paint layer 24 due to its similar property to the first paint layer. The appropriate temperature and time for drying the second paint layer 26 (S40) would be 200° C. and 10 minutes respectively. Also, it is better for the first and second paint layers 24 and 26 to be made of a heat-resisting ceramic material so as not to be carbonized or discolored when heated.

As previously described, when the first and second paint layers 24 and 26 are sprayed on the glass member 22 in order, the reflecting materials of the first paint layer 24 and the color of the second paint layer 26 are visible simultaneously. Accordingly, the refrigerator has a more elegant image with various colors and a light reflecting effect on the whole surface of it as well as the surface of its doors 15 and 15', compared to the prior art refrigerator having a single color only.

Preferably, a protecting film (not shown) is being covered over the second paint layer 2.6 of the finished external decorating member 20 (S50), because the second paint layer 26 which is relatively vulnerable to an impact may be scratched on the way of conveyance. In other words, the external decorating member 20 may be conveyed with the protecting film to protect the second paint layer 26, and the protecting film will be detached right before the external decorating member 20 is installed on the refrigerator doors.

Finally, the process of installing the external decorating member 20 on the doors 15 and 15' is performed (S60). The external decorating member 20 can be installed on the doors 15 and 15' in a way that the second paint layer 26 is exposed, but more preferably, the external decorating member 20 is installed on the doors 15 and 15' in a way that the second paint layer 26 comes in contact with the front surface of its corresponding door (i.e., the surface of the outer case 15*a*). This is to prevent the second paint layer 26 from being scratched or peeled off when exposed to the outside. Also, the external decorating member 20 can be installed in various ways. For example, two directional adhesive tape or glue can be used to install the external decorating member 20 on the door 15, or a predetermined corporate body may be provided to the door 15 to install the external decorating member 26.

The external decorating member 20 itself has an improved stiffness because of the glass member 22 made of tempered glass and thus plays a role of protecting the doors 15 and 15'.

INDUSTRIAL APPLICABILITY

As described above, an external decorating member for doors of a refrigerator has the following advantages.

First, the external decorating member of the present invention increases the commercial value of the refrigerator. When the external decorating member of the present invention is attached to the front surfaces of the refrigerator doors, first and second paint layers are exposed through a glass member. Accordingly, various colors and a twinkling effect make the refrigerator look more elegant. Thus, the refrigerator of the present invention satisfies consumers with their various tastes, resulting in more demand for the product.

Second, The external decorating member 20 itself has an improved stiffness because of the glass member 22 made of tempered glass and thus protects the refrigerator doors from being easily impaired by an external impact.

While the present invention has been described and illustrated herein with reference to the preferred embodiment thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A refrigerator door comprising an external decorating member, the external decorating member comprising:

a glass member having a first side and a second side;

a first paint layer formed on the second side of the glass member and having reflecting materials for reflecting light which passes through the glass member, the first paint layer being sprayed on the second side of the glass member; and a second paint layer formed on top of the first paint layer and having a predetermined color, the second paint layer being configured to face a front surface of the door of the refrigerator so that the first side of the glass member functions as an outer surface of the door of the refrigerator, wherein the second paint layer is sprayed on top of the first paint layer.

2. The refrigerator door comprising the external decorating member of claim 1, wherein the glass member is a plate member attached to the front surface of the refrigerator door.

3. The refrigerator door comprising the external decorating member of claim 2, wherein the glass member has the same size as the front surface of its corresponding door.

4. The refrigerator door comprising the external decorating member of claim 1, wherein the glass member has an improved stiffness by being hardened by heat.

5. The refrigerator door comprising the external decorating member of claim 1, wherein the reflective first paint layer has a thickness in the range of 5-20 mμ.

6. The refrigerator door comprising the external decorating member of claim 5, wherein the reflective first paint layer has a thickness in the range of 10-15 mμ.

7. The refrigerator door comprising the external decorating member of claim 1, wherein the reflecting material of the reflective first paint layer is made of at least one of an inorganic pigment or metal particles.

8. The refrigerator door comprising the external decorating member of claim 1, wherein the reflective first paint layer is spontaneously dried at room temperature before the second paint layer is formed.

9. The refrigerator door comprising the external decorating member of claim 1, wherein the second paint layer has a thickness in the range of 5-35 mμ.

10. The refrigerator door comprising the external decorating member of claim 9, wherein the second paint layer has a thickness in the range of 10-30 mμ.

11. The refrigerator door comprising the external decorating member of claim 1, wherein the second paint layer is artificially dried by heat.

12. The refrigerator door comprising the external decorating member of claim 1, wherein the reflective first paint layer and the second paint layer are made of a heat-resisting ceramic pigment.

13. A refrigerator comprising the refrigerator door of claim 1.

* * * * *